US011849869B2

(12) United States Patent
Wiginton

(10) Patent No.: US 11,849,869 B2
(45) Date of Patent: Dec. 26, 2023

(54) COMIC AND CARD ENCAPSULATIVE APPARATUS

(71) Applicant: Jason Wiginton, Corpus Christi, TX (US)

(72) Inventor: Jason Wiginton, Corpus Christi, TX (US)

( * ) Notice: Subject to any disclaimer, the term of this patent is extended or adjusted under 35 U.S.C. 154(b) by 195 days.

(21) Appl. No.: 17/541,220

(22) Filed: Dec. 2, 2021

(65) Prior Publication Data

US 2023/0172373 A1 Jun. 8, 2023

(51) Int. Cl.
*A47G 1/06* (2006.01)
*A63F 1/06* (2006.01)

(52) U.S. Cl.
CPC ..... *A47G 1/06* (2013.01); *A63F 1/062* (2013.01); *A47G 2001/0694* (2013.01)

(58) Field of Classification Search
CPC ..... A47G 1/06; A47G 1/0605; A47G 1/0611; A47G 1/065; A47G 1/12; A47G 1/14; A47G 1/141; A47G 1/142; A47G 1/143; A47G 2001/0694; A47G 2001/145; A47G 2001/146; A63F 1/062; G09F 1/12; G09F 3/18; G09F 3/185; G09F 3/20; G09F 3/201; G09F 3/202; G09F 3/203; G09F 3/204; G09F 3/205; G09F 3/206; G09F 3/207; G09F 3/208
USPC ..... 206/0.82, 0.83, 0.84, 232, 449, 775; 40/748, 755
See application file for complete search history.

(56) References Cited

U.S. PATENT DOCUMENTS 4,979,619 A * 12/1990 Hager ..... B42F 7/00 150/147
6,029,807 A * 2/2000 Love ..... B65D 85/48 206/0.82
D469,963 S * 2/2003 Ueno ..... D6/300
6,851,556 B1 * 2/2005 Valdez ..... G09F 3/20 40/672
8,376,133 B2 * 2/2013 Macor ..... B65D 85/58 206/0.8
9,758,288 B2 * 9/2017 Bornstein ..... B65D 25/54
9,870,658 B1 * 1/2018 McWilliam ..... G09F 3/207
11,528,974 B1 * 12/2022 Myers ..... B42F 7/04
11,605,312 B2 * 3/2023 Chiu ..... A47G 1/12
D993,324 S * 7/2023 Spiegel ..... D21/392
2003/0196362 A1 * 10/2003 Harwell ..... G09F 1/12 40/781
2007/0089344 A1 * 4/2007 Ting ..... A47G 1/143 40/754
2007/0113451 A1 * 5/2007 McDowell ..... G09F 3/20 40/642.02
2011/0031139 A1 * 2/2011 Macor ..... B01L 3/54 206/232
2013/0081313 A1 * 4/2013 Hornbeek ..... A47G 1/065 40/721
2014/0168929 A1 * 6/2014 Terry ..... G09F 7/00 29/592.1

(Continued)

*Primary Examiner* — Joshua E Rodden
(74) *Attorney, Agent, or Firm* — Steven Rinehart

(57) ABSTRACT

A protective apparatus for encapsulating printed collectibles, including comic books and cards. The protective apparatus including a forward panel forming a recess adapted to receive a base panel. The printed collectible positions between the forward panel and the base panel. The base panel is hingedly connected to a stand.

7 Claims, 6 Drawing Sheets

(56) References Cited

U.S. PATENT DOCUMENTS

| | | | | |
|---|---|---|---|---|
| 2014/0283425 | A1* | 9/2014 | Vallar | A47G 1/0616 40/745 |
| 2017/0253067 | A1* | 9/2017 | Nelson | B65D 25/10 |
| 2020/0187680 | A1* | 6/2020 | Yoo | A47G 1/142 |
| 2022/0007859 | A1* | 1/2022 | Jalali | G09F 1/14 |
| 2022/0254280 | A1* | 8/2022 | Chiu | G09F 3/18 |
| 2023/0073593 | A1* | 3/2023 | Blom | A45C 11/18 |
| 2023/0218979 | A1* | 7/2023 | Lee | A63F 1/062 273/148 A |

* cited by examiner

COMIC AND CARD ENCAPSULATIVE APPARATUS

BACKGROUND OF THE INVENTION

Field of the Invention

This invention relates to apparati for protecting documents and printed materials, and more particularly relates to a device designed to protect comic books, card and other printed collectibles, and even coins, of various sizes in an apparatus in which obverse and reverse sides can be viewed.

Description of the Related Art

Interest in comic book and card collecting has exploded over the last several decades. Formerly, interest was limited primarily to hobbyists interested in sports and comic book collectors. As these collectibles have become older, they have increased rapidly in value. With that increase in value comes an increased need to protect and allow inspection of the condition of comic books, cards, printed matter and even coins. There is now broad interest from investors in these collectibles.

There exists no efficient means in the art of protecting and displaying these items, either in personal collections or at retail locations at specialty stores seeking to sell them. Current methods and apparati are not effective and often comprise simple transparent envelopes or cumbersome assemblies. Cards are often stored in stacks or boxes and not protected from moisture or the elements. Oil and dirt from frequent handling can damage printed collectibles and severely diminish their value. Collectors often needlessly thumb through conic books which are not protected, damaging pages and margins.

There exists a need in the art for a device that efficiently encapsulates and protects comic books, cards and printed matter, while still allowing inspection of their condition. Accordingly, there is a need to provide a simple and effective encapsulative apparatus such as that shown and described herein.

SUMMARY OF THE INVENTION

From the foregoing discussion, it should be apparent that a need exists for a comic and card encapsulative apparatus. Beneficially, such an apparatus would overcome many of the difficulties and concerns with other technologies by providing an apparatus which is easily manufactured and assembled, and which allows viewing printed matter and inspection, as well as upright or horizontal display.

The present invention has been developed in response to the problems and needs in the art that have not yet been fully solved by currently available apparati and methods. Accordingly, the present invention has been developed to provide an encapsulative apparatus for a printed collectible comprising: a transparent forward panel having a planar forward surface, the forward panel comprising: a first sidewall circumscribing the perimeter of the planar forward surface, the first sidewall jutting rearwardly and defining a large recess rearward of the planar forward surface adapted to receive a base panel; a plurality of elongated protuberances running one of laterally and vertically across a rearward surface of the faceplate, the elongated protuberances bifurcating the large recess formed by the first sidewall into two or more smaller recesses, including an upper recess adapted to receive a placard and a lower recess adapted to receive a printed collectible; a base panel adapted to insert into the large recess and form a friction fit with the forward panel, the base panel comprising: two prongs adapted to form a hinged connection with a stand, the prongs each defining an aperture, and a second sidewall circumscribing the perimeter of the base panel, the second sidewall jutting rearwardly and defining a second large recess rearwardly within which a stand positions; and a stand hingedly affixed to of the base panel, the stand comprising one or more feet, the stand comprising two protuberances adapted to snap into the apertures.

The stand may further comprise a rectangular tab rising superiorly to the protuberances adapted to prevent the stand from over-rotating. The base panel may comprise a cantilevering upper surface which juts forward. In various embodiments, the stand defines a track within which a shuttle travels.

The shuttle may be adapted to act as a foot adjustable in height. A distal end of the stand may be delta-shaped. The forward panel, base panel and stand may all fabricated of a transparent, polymeric material.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
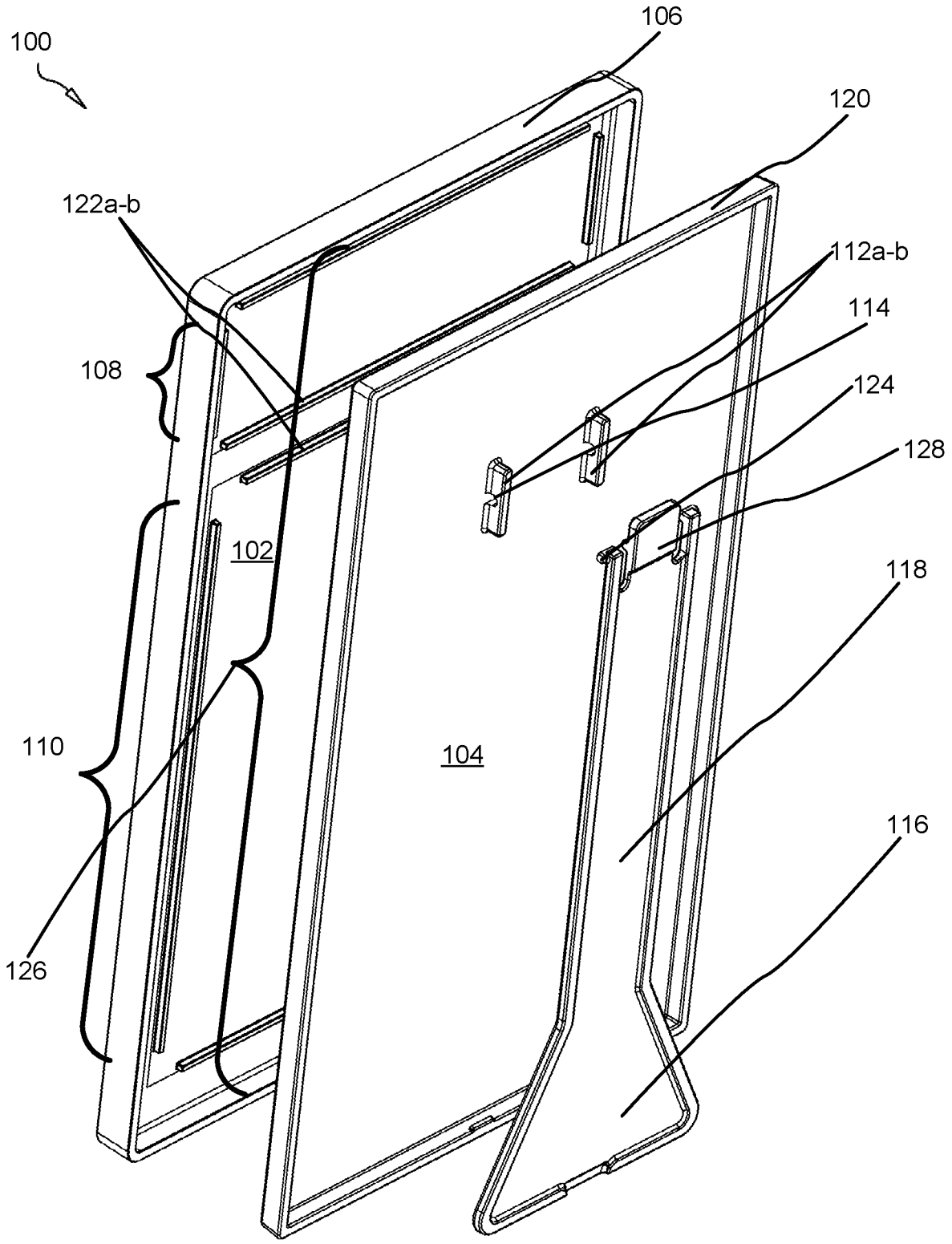
FIG. 1 is an exploded, elevational rearward-side perspective view of comic and card encapsulative apparatus in accordance with the present invention.
Figure 2:
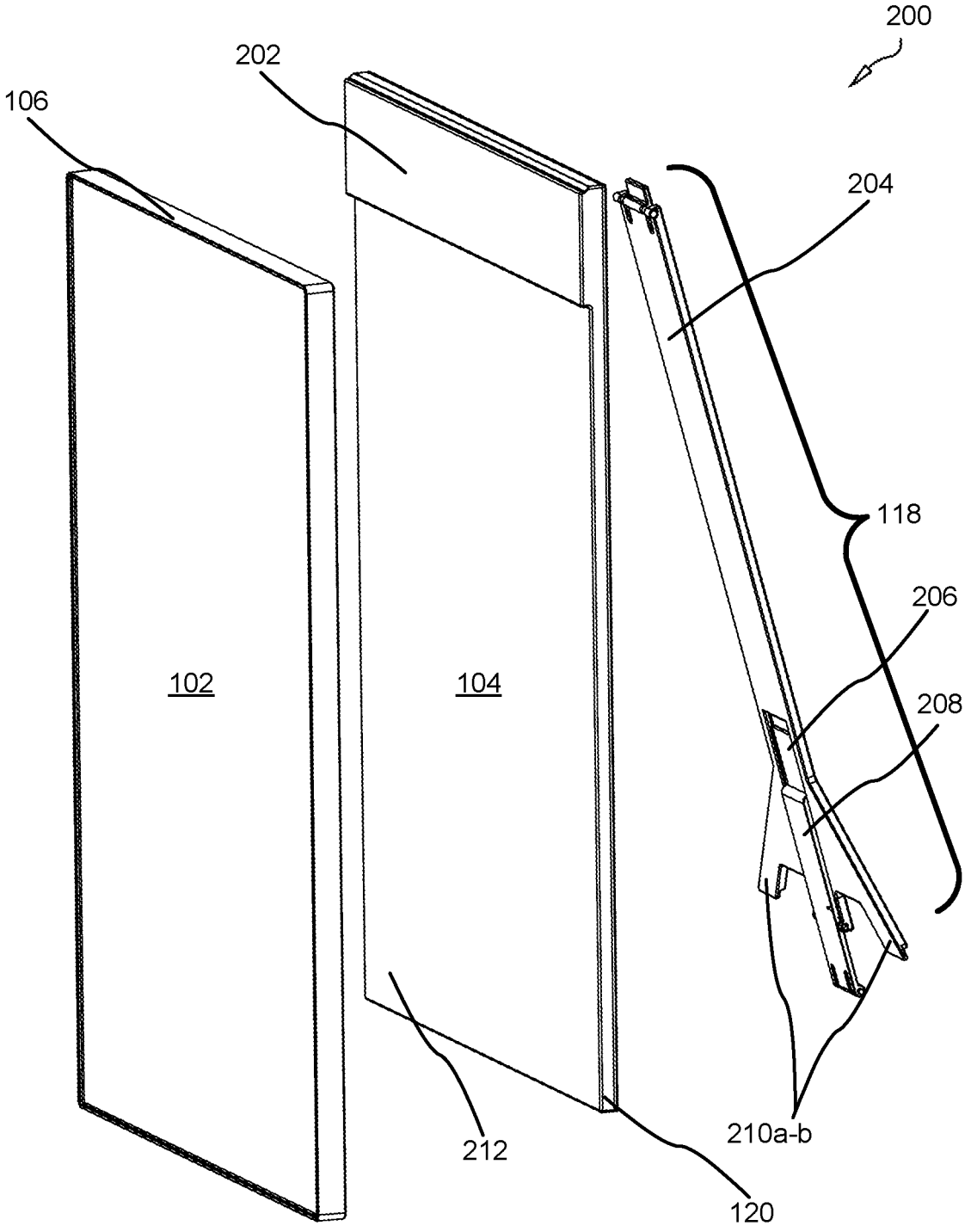
FIG. 2 is an exploded, elevational forward-side perspective view of comic and card encapsulative apparatus in accordance with the present invention.
Figure 3:
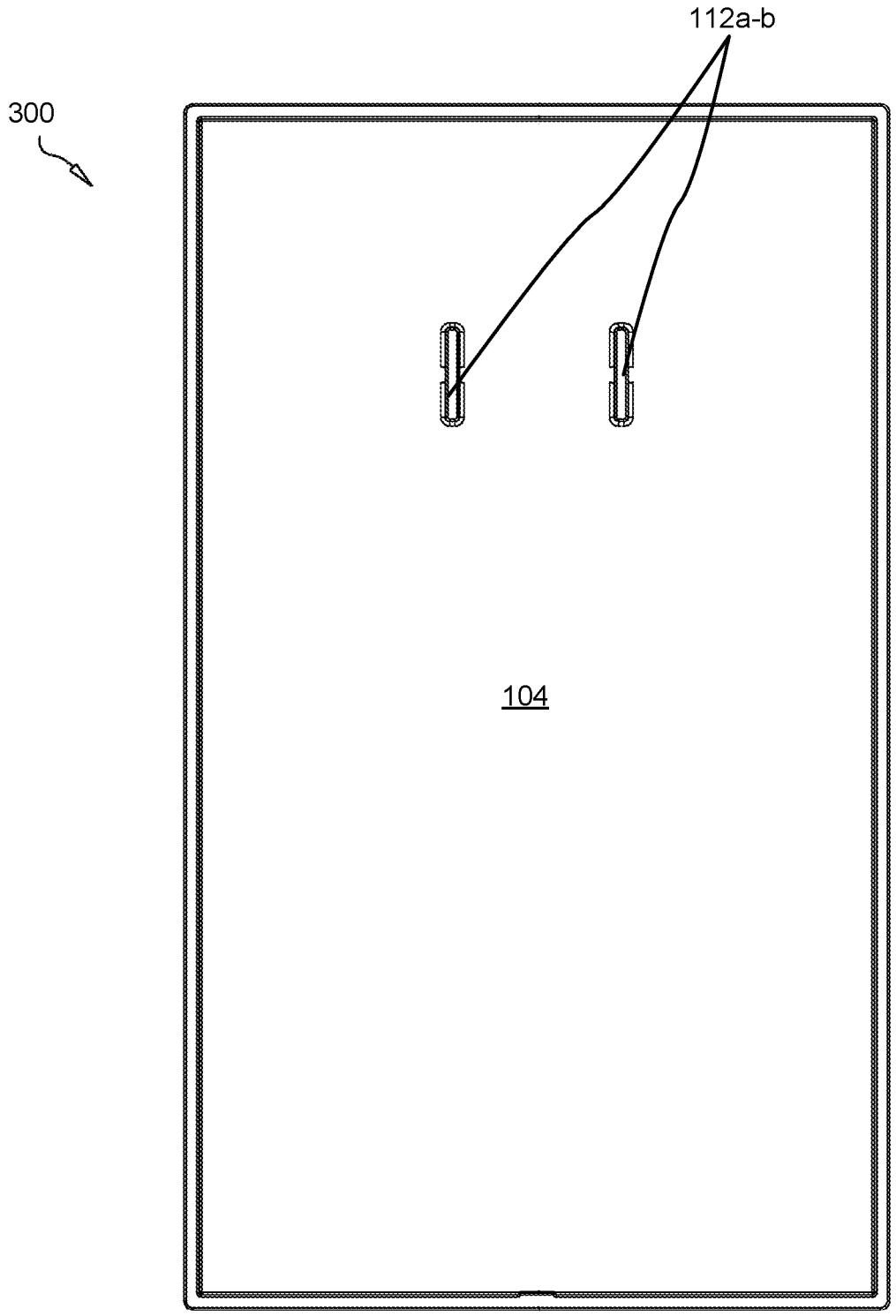
FIG. 3 is a rearward perspective view of comic and card encapsulative apparatus in accordance with the present invention.

FIGS. 1-3 illustrate perspective views of comic and card encapsulative apparati 100, 200, 300 in accordance with the present invention.

The device 100 comprises a faceplate 102 having a planar forward surface. The faceplate 102 may also be termed a front cover or front panel 102. The faceplate 102 is preferably fabricated from a rigid or semi-rigid polymeric material which is transparent, though which may be translucent in some embodiments to protect encapsulated printed matter from UV light or exposure.

The rearward surface of the faceplate 102 is not planar. The rearward surface comprises a sidewall 106 which circumscribes the perimeter of the faceplate 102 and/or planar forward surface of the faceplate 102. The sidewall 106 juts rearwardly from the faceplate 102 creating rectangular recesses 108, 110, 126 in some embodiments. In other embodiments, the sidewall 106 acts in conjunction with various elongated protuberances 122 form the recesses 108, 110.

The recess 126 formed by the sidewall 106 may be bifurcated by the elongated protuberances 122 into a small, upper recess 108 and a larger, lower recess 110. The elongated protuberances 122 may run laterally or vertically within the recess 126.

A baseplate 104 inserts into the recess 110, or recesses 126, 108, 110, created by the faceplate 102. The baseplate 104 also comprises a circumscribing sidewall 120 which contours an inside edge of the sidewall 106. The baseplate 104 is adapted to form a friction fit with the rearward surface of the faceplate 104 and insert therein. The baseplate 104 forms a friction fit with the faceplate 102.

A comic book, card or other printed material positions between the faceplate 104 and the baseplate 106 in a large recess 110. The small recess 108 is adapted to receive an identifying placard which may comprise a name of the comic book or card, a year printed, a rating or condition, a price, or other identifying information.

In various embodiments, an upper portion of the baseplate 104 comprises an upper surface 202 which cantilevers forward of the lower surface 212 of the baseplate 104. Otherwise stated, the lower surface 212 is recessed more rearwardly than the upper surface. This disparity is adopted to allow comic books or other printed material which is thicker to position within the lower recess 110 without reducing the friction fit holding a placard in place between the upper surface 202 and the faceplate 102.

In various embodiments, a stand 118 affixes to prongs 112 positioned above a center point on the rearward surface of the baseplate 104. This stand 118 may comprise a delta-shaped foot 116. In various embodiments, the stand 118 is hingedly affixed to the prongs 112*a-b* using a snap-lock mechanism in which protuberances 114 on the stand 118 snap into apertures 124 defined by the prongs 112.

The proximal (or upper) end of the stand which affixed to the baseplate 104 may comprise a rectangular tab 128 adapted to prevent the stand 118 from being over-rotated relative to the baseplate 104.

In some embodiments, the stand 118 defines a track 206 within which a shuttle 208 travels. The shuttle 208 slides downwardly and may form a friction fit with the stand 118 within the track 206. In various embodiments, the shuttle 208 affixes to the baseplate 104.

In other embodiments, the stand 118 comprises two or more feet 210 adapted to rest upon a planar surface and angle the apparatus 100 into a largely perpendicular, orthogonal or angled posture relative to the planar surface upon which the apparatus 100, 200 is resting.

The prongs are disposed on the upper half of the apparatus 300.

Each of the embodiments 100, 200, 300 may comprise or consist of the components indicated.

Figure 4:
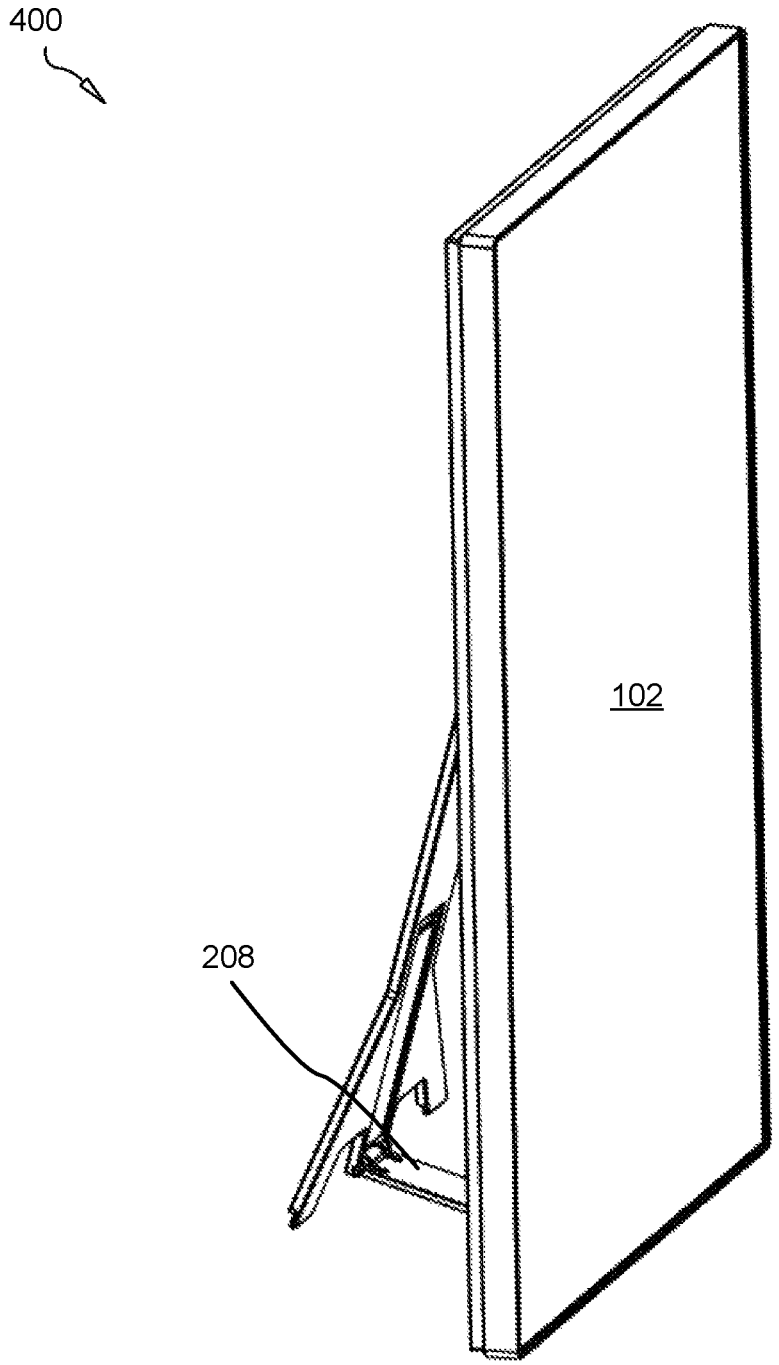
FIG. 4 is an isometric forward-side perspective view of comic and card encapsulative apparatus in accordance with the present invention.
Figure 5:
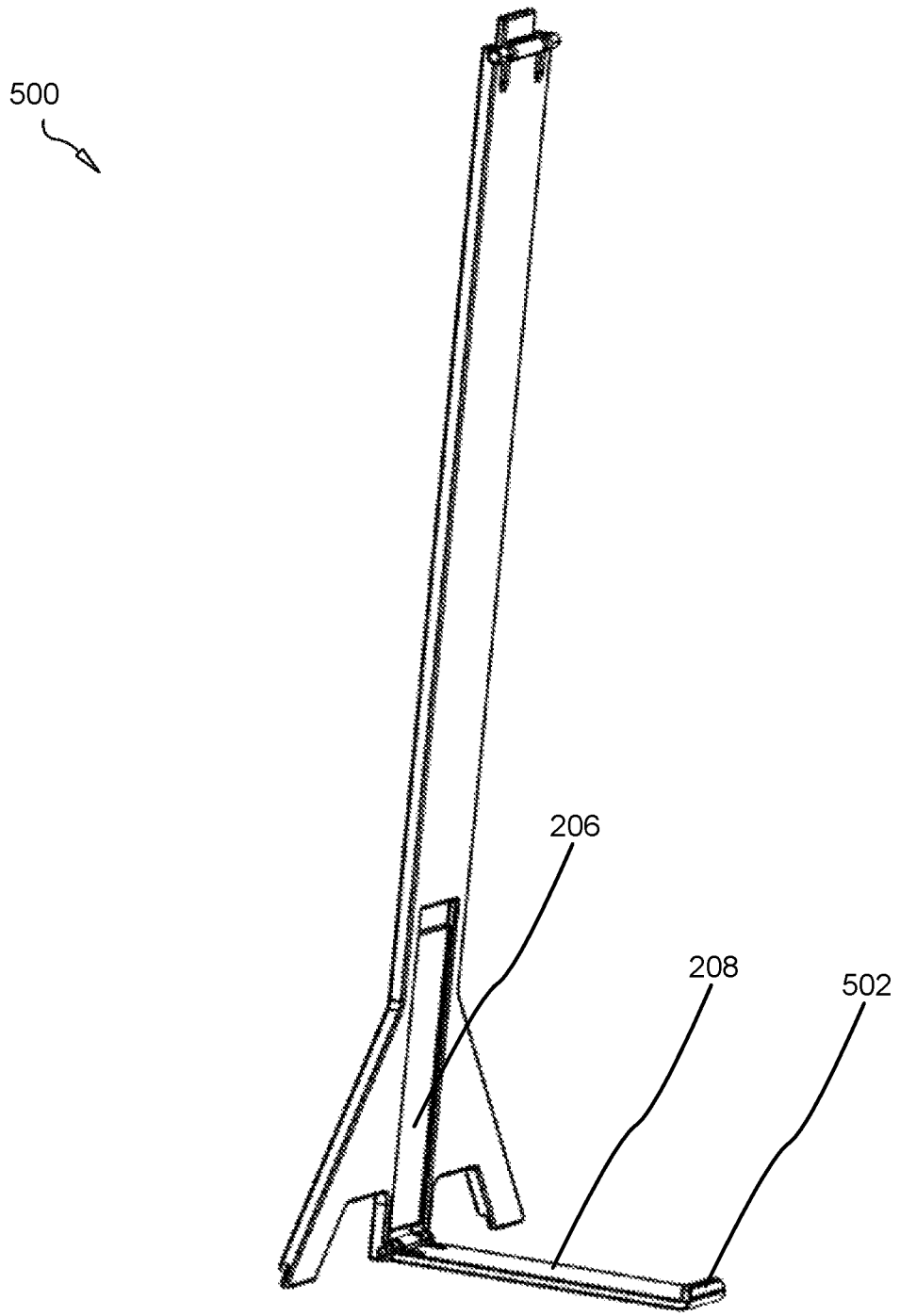
FIG. 5 is a rearward perspective view of stand assembly of comic and card encapsulative apparatus in accordance with the present invention.
Figure 6:
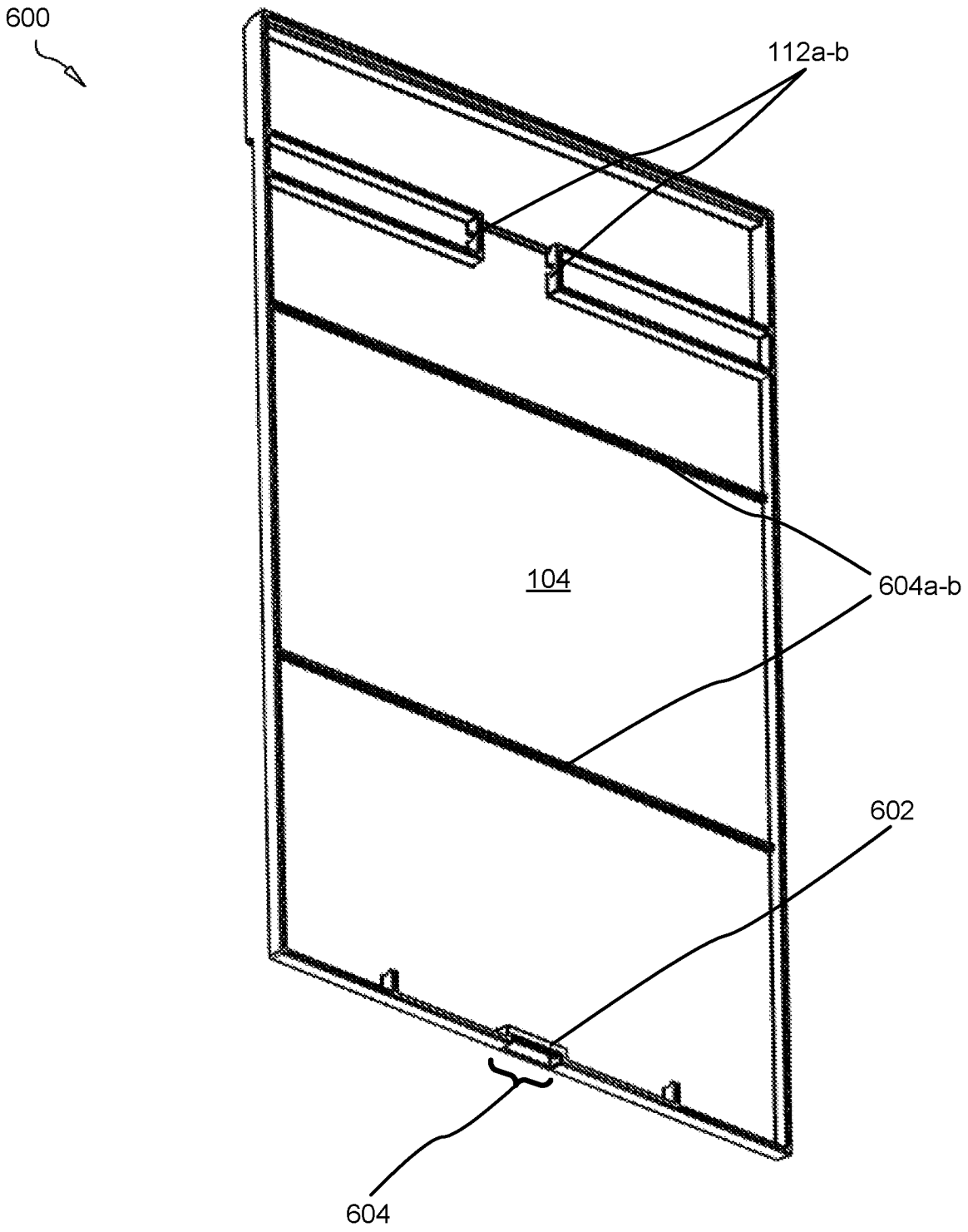
FIG. 6 is a rearward perspective view of a baseplate of a comic and card encapsulative apparatus in accordance with the present invention.

FIGS. 4-6 illustrate various perspective views of comic and card encapsulative apparatus 400, 500, 600 and/or its components in accordance with the present invention.

The shuttle 208 may comprise an upwardly jutting edge 502 adapted to snap into a channel 602 forming a rectangular recess 604, the channel 502 interrupting the sidewall 120 along a lower edge.

In various embodiments, the baseplate 104 comprises horizontally running stabilizers or beams 604*a-b* adapted to add rigidity and strength to the baseplate 104.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An encapsulative apparatus for a printed collectible comprising:

a transparent forward panel having a planar forward surface, the forward panel comprising:

a first sidewall circumscribing a perimeter of the planar forward surface, the first sidewall jutting rearwardly and defining a large recess rearward of the planar forward surface;

a plurality of elongated protuberances running one of laterally and vertically across a rearward surface of the faceplate, the elongated protuberances bifurcating the large recess formed by the first sidewall into two or more smaller recesses, including an upper recess adapted to receive a placard and a lower recess adapted to receive a printed collectible;

a base panel adapted to insert into the large recess and form a friction fit with the forward panel, the base panel comprising:

two prongs adapted to form a hinged connection with a stand, the prongs each defining an aperture, and a second sidewall circumscribing a perimeter of the base panel, the second sidewall jutting rearwardly and defining a second large recess rearwardly within which a stand positions; and the stand hingedly affixed to the base panel, the stand comprising one or more feet, the stand comprising two protuberances adapted to snap into the apertures.

2. The encapsulative apparatus of claim 1, wherein the stand further comprises a rectangular tab rising superiorly to the protuberances adapted to prevent the stand from over-rotating.

3. The encapsulative apparatus of claim 1, wherein the base panel comprises a cantilevering upper surface which juts forward.

4. The encapsulative apparatus of claim 1, wherein the stand defines a track within which a shuttle travels.

5. The encapsulative apparatus of claim 4, wherein the shuttle is adapted to act as a foot adjustable in height.

6. The encapsulative apparatus of claim 1, wherein a distal end of the stand is delta-shaped.

7. The encapsulative apparatus of claim 1, wherein the forward panel, base panel and stand are all fabricated of a transparent, polymeric material.

* * * * *